US006972725B1

(12) United States Patent
Adams

(10) Patent No.: US 6,972,725 B1
(45) **Date of Patent: *Dec. 6, 2005**

(54) ULTRA-BROADBAND ANTENNA INCORPORATED INTO A GARMENT

(75) Inventor: Richard C. Adams, Chula Vista, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/677,189

(22) Filed: Oct. 2, 2003

Related U.S. Application Data

(63) Continuation-in-part of application No. 10/263,943, filed on Oct. 3, 2002, now Pat. No. 6,788,262, which is a continuation-in-part of application No. 10/061,639, filed on Jan. 31, 2002, now Pat. No. 6,590,540.

(51) Int. Cl.[7] ..... H01Q 1/12
(52) U.S. Cl. ..... 343/718; 343/897
(58) Field of Search ..... 343/718, 897, 343/783, 700 MS; H01Q 1/12

(56) References Cited

U.S. PATENT DOCUMENTS 4,041,394 A * 8/1977 Pate ..... 455/100
5,148,002 A * 9/1992 Kuo et al. ..... 219/211
6,259,399 B1 * 7/2001 Krasner ..... 342/357.06
6,356,238 B1 * 3/2002 Gainor et al. ..... 343/718
6,377,216 B1 * 4/2002 Cheadle et al. ..... 343/700 MS
6,433,743 B1 * 8/2002 Massey et al. ..... 343/700 MS
6,590,540 B1 * 7/2003 Adams et al. ..... 343/718
6,788,262 B1 * 9/2004 Adams et al. ..... 343/718

* cited by examiner

*Primary Examiner*—Hoanganh Le
(74) *Attorney, Agent, or Firm*—Andrew J. Cameron; Michael A. Regan; Peter A. Lipovsky

(57) ABSTRACT

A multi-antenna garment comprising a first and second antenna incorporated into an electrically nonconductive garment, with tubular composites to improve gain and mitigate radiation hazard. The first antenna includes first and second RF elements attached to a first garment so that a gap exists between them, where the RF elements each form a band when the garment is worn by a wearer. The second antenna includes third, fourth, fifth, and sixth RF elements attached to a second garment worn over the first garment. RF feeds are electrically connected to the first, third, and fifth RF elements. Ground feeds are electrically connected to the second, fourth, and sixth RF elements. Insulating material disposed over gaps between the first and second, the third and fourth, and the fifth and sixth RF elements and in pockets in the regions of the RF feeds limits the wearer's exposure to electromagnetic field to acceptable levels.

14 Claims, 10 Drawing Sheets

ULTRA-BROADBAND ANTENNA INCORPORATED INTO A GARMENT

CROSS REFERENCES TO RELATED APPLICATIONS

This application is a continuation-in-part of U.S. patent application Ser. No. 10/263,943, entitled ULTRA-BROADBAND ANTENNA INCORPORATED INTO A GARMENT WITH RADIATION ABSORBER MATERIAL TO MITIGATE RADIATION HAZARD, filed on Oct. 3, 2002 and issued as U.S. Pat. No. 6,788,262 on Sep. 7, 2004, which is a continuation-in-part of U.S. patent application Ser. No. 10/061,639, entitled ULTRA-BROADBAND ANTENNA INCORPORATED INTO A GARMENT, filed on Jan. 31, 2002 and issued as U.S. Pat. No. 6,590,540 on Jul. 8, 2003, and which is herein incorporated by reference.

BACKGROUND OF THE INVENTION

This invention relates generally to the field of antennas. More specifically, this invention relates to an improved ultra-broadband antenna, comprising of a first and second antenna, which is incorporated into a garment that may be worn around a human torso.

The purpose of the first and second antenna incorporated into a garment is to provide ultra-wideband capability—the ability to send or receive a signal at any frequency between 30 and 500 MHz—while hiding the identity of the radio operator from snipers. Because disruption of command, communications, and control is a paramount goal of snipers, reduction of the visual signature of an antenna is highly desirable. Therefore, a need exists for a wideband, man-carried antenna that does not have a readily identifiable visual signature.

Although the VSWR of the antenna in U.S. Pat. No. 6,590,540 is less than 3:1 for almost the entire frequency range of 30 to 500 MHz, the gain of the antenna for frequencies greater than 200 MHz was too small. Many antennas for hand-held devices have gains on the order of −10 dBi. The vest antenna had a gain comparable to this in the frequency range of 30 to 90 MHz, which is important for military use. However, the gain for frequencies higher than 200 MHz was often less than −20 dBi, too small for efficient operation. Thus, there is a need for an antenna that provides ultra-broadband capability with improved gain.

SUMMARY OF THE INVENTION

The invention is directed to an ultra-broadband antenna, comprising of a first and second antenna, which is incorporated into an electrically nonconductive garment and includes tubular composites to improve gain and to mitigate radiation hazards. The ultra-broadband antenna operates over a frequency range of about 30 MHz to about 500 MHz.

The antenna garment includes a first antenna integrated into a first garment. First antenna operates very efficiently over a frequency range of about 30 MHz to about 90 MHz. First antenna includes a first radio frequency (RF) element, a second RF element, a shorting strap, left shoulder strap, right shoulder strap, first RF feed, first ground feed, and impedance matching circuit, all of which are attached to first garment. First and second RF elements are attached to first garment so that the RF elements are separated by a gap having a distance $D_1$. Generally, $D_1<2.5$ cm, although the scope of the invention includes the distance $D_1$ being greater than 2.5 cm as may be required to suit the requirements of a particular application. When RF energy is input, a voltage difference is generated across the gap.

The antenna garment also includes a second antenna integrated into a second garment, which is worn over and attached to first garment by fasteners such as Velcro® or snaps or may also be sewn. Second antenna operates very efficiently over a frequency range of about 150 MHz to about 500 MHz. Second antenna includes third and fourth RF elements, second RF feed, second ground feed, all of which are attached to the front section of second garment. Second antenna also includes fifth and sixth RF elements, third RF feed, third ground feed, all of which are attached to the back region of second garment. By way of example only, third, fourth, fifth and sixth RF elements are rectangular elements separated by a small gap, having a distance $D_2$. Other elements that may be used include a triangle (to form a bowtie antenna), a teardrop with a tapered feed, a "home plate," and others. Generally, $D_2 \leqq 0.7$ cm, although the scope of the invention includes the distance $D_2$ being greater than 0.7 cm as may be required to suit the requirements of a particular application. When RF energy is input, a voltage difference is generated across the gap between the third and fourth RF elements and between the fifth and sixth RF elements.

On the inside layer of first and second garments, insulating material is disposed within first and second antennas. Insulating material is disposed in pockets sewn in the regions of the RF feeds. Insulating material is also disposed over the length and width of the gap that separates first and second RF elements, third and fourth RF elements, and fifth and sixth RF elements. By way of example, insulating material may be made of material generally called tubular composites. To fabricate these tubular composites, cylinders of copper and/or ferrite tubules, 25 microns long and 1 micron in diameter, are mixed in controlled amounts with polyurethane or other polymers, which then solidify into a rubber-like sheet. Insulating material reduces the energy that flows into the body and shields the wearer from electromagnetic radiation. Disposed over the length and width of gaps that separate the RF elements, insulating material also reflects energy without shorting first and second antennas.

Use of multiple antennas with a diplexer allows optimization of each antenna within a narrower frequency range. A diplexer provides a passive means, i.e., no operator intervention required, to route signals from a radio to the appropriate antenna for efficient operation. A single-pole, two-throw switch is an example of an active means, i.e., requires operator intervention, of directing the signal to the appropriate antenna.

BRIEF DESCRIPTION OF THE DRAWINGS

For a more complete understanding of the improved ultra-broadband antenna incorporated into a garment, reference is now made to the following detailed description of the embodiments as illustrated in the accompanying drawings wherein.

Throughout the several views, like elements are referenced using like references.

DESCRIPTION OF THE PREFERRED EMBODIMENT

Figure 1A:
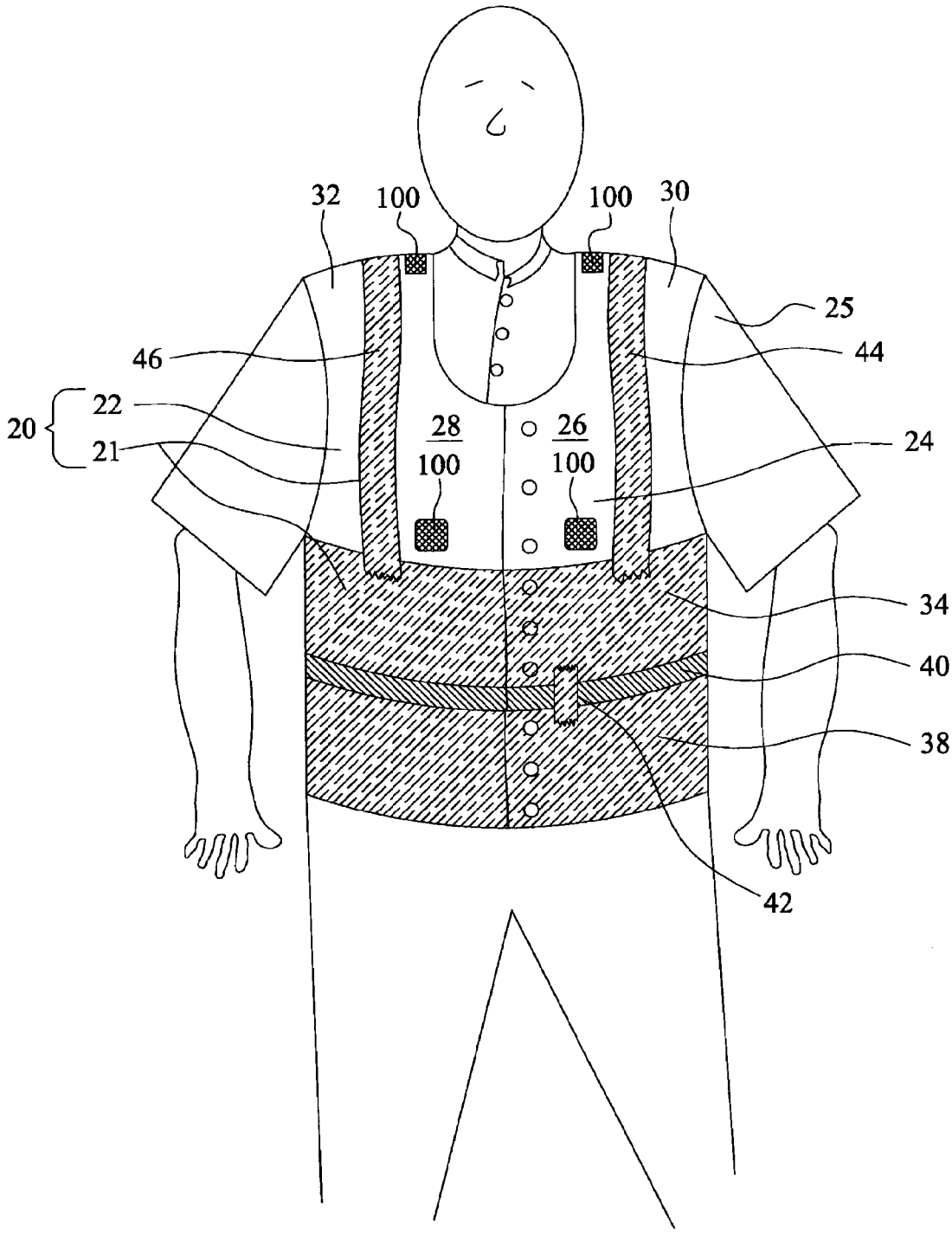
FIG. 1A illustrates an anterior view of a first antenna incorporated into a garment as shown worn by a wearer.
Figure 1B:
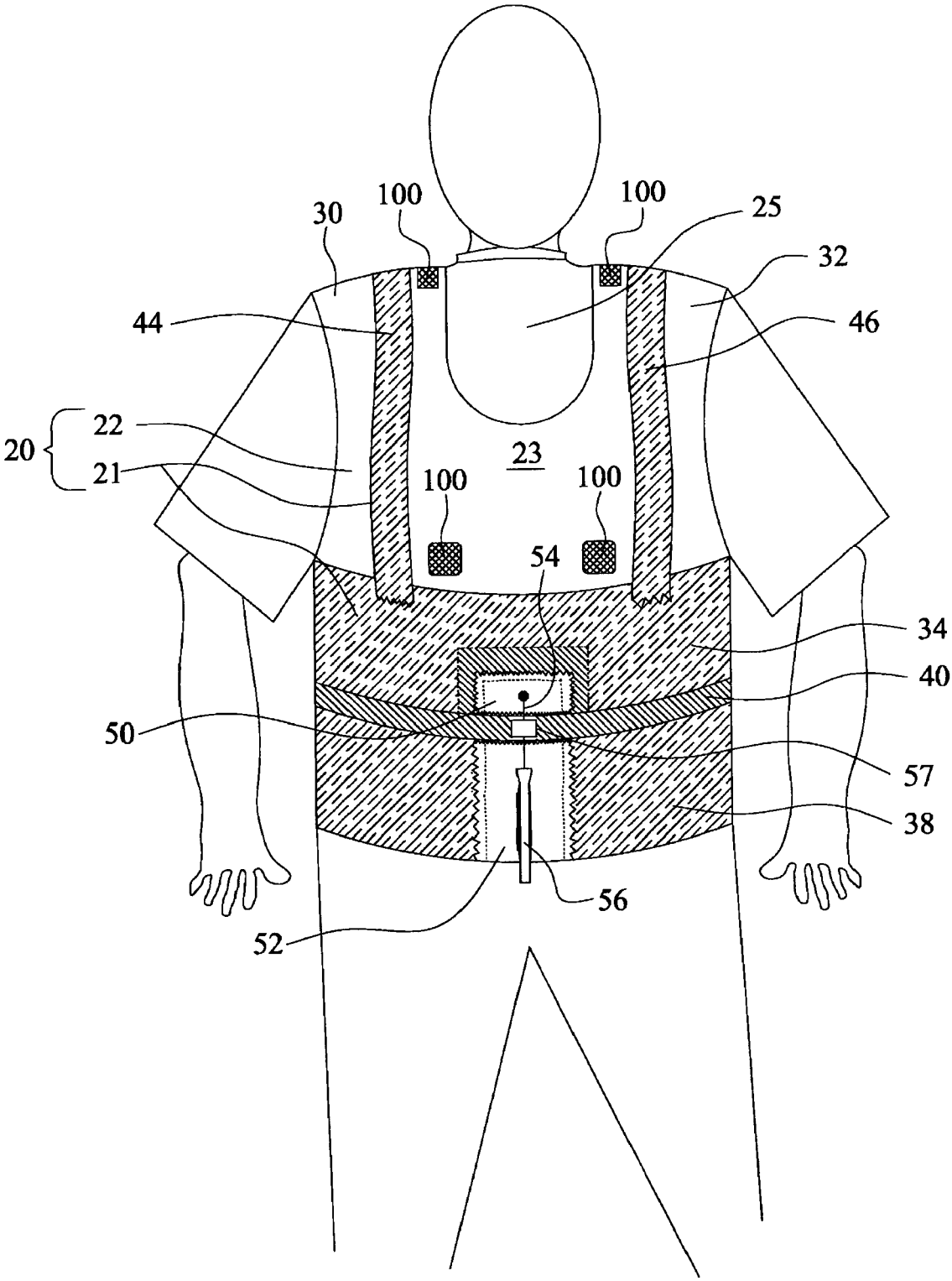
FIG. 1B shows a dorsal view of the antenna garment shown in FIG. 1.

Referring to FIGS. 1A and 1B, an antenna garment 20 worn by a human wearer 25 is shown that includes a first antenna 21 integrated into a first garment 22. First antenna 21 operates very efficiently over a frequency range of about 30 MHz to about 90 MHz. First antenna 21 is integrated into first garment 22 so that first antenna 21 offers no distinctive visual signature that would identify the person wearing antenna garment 20 as a radio operator. First garment 22 is made of an electrically nonconductive material such as a woven fabric selected from the group that includes cotton, wool, polyester, nylon, Kevlar, rayon, and the like. The electrically conductive material of first garment 22 may also include polyurethane for waterproofing. First garment 22 has an outer layer with an anterior or front section 24 and a dorsal or back region 23. From the perspective of the human wearer 25, front section 24 of first garment 22 includes a left anterior front section 26 and a right anterior front section 28. First garment 22 also has a left shoulder section 30 and a right shoulder section 32. First antenna 21 includes a first radio frequency (RF) element 34, a second RF element 38, a shorting strap 42, left shoulder strap 44, right shoulder strap 46, first RF feed 54, first ground feed 56, and impedance matching circuit 57, all of which are attached to first garment 22. RF elements 34 and 38 are attached to first garment 22 so that the RF elements are separated by a gap 40, having a distance $D_1$. Generally, $D_1 \leqq 2.5$ cm, although the scope of the invention includes the distance $D_1$ being greater than 2.5 cm as may be required to suit the requirements of a particular application. When RF energy is input, a voltage difference is generated across gap 40.

As shown in FIG. 1B, a flexible, electrically conductive patch 50 is sewn and/or bonded to the bottom center area portion of first RF element 34 on the dorsal side 23 of first garment 22. Also a flexible, electrically conductive patch 52 is sewn and/or bonded to the top center area of second RF element 38 on the dorsal side 23 of first garment 22. The patches 50 and 52 are separated by gap 40, having a distance $D_1$. First RF feed 54 is electrically connected to impedance matching circuit 57, which in turn is electrically connected to patch 50 by soldering or other conventionally known methods for electrically connecting a wire to another electrically conductive structure. Impedance matching circuit 57 is used to finely match the impedance of first antenna 21 with an external load, not shown, and the impedance of the wearer 25. A first ground feed 56 is electrically coupled to patch 52 by soldering or other means. Patches 50 and 52 provide a generally heat resistive buffer so that impedance matching circuit 57 and first ground feed 56 may be soldered to first antenna 21 without causing heat damage that would otherwise result if first RF feed 54 and first ground feed 56 were directly soldered to RF elements 34 and 38 in applications wherein the latter are made of Flectron®. It is to be understood that first RF feed 54 and first ground feed 56 are RF isolated from each other. By way of example, patches 50 and 52 may be made of electrically conductive copper foil tape such as 3M Scotch Tape, Model No. 1181.

Figure 2A:
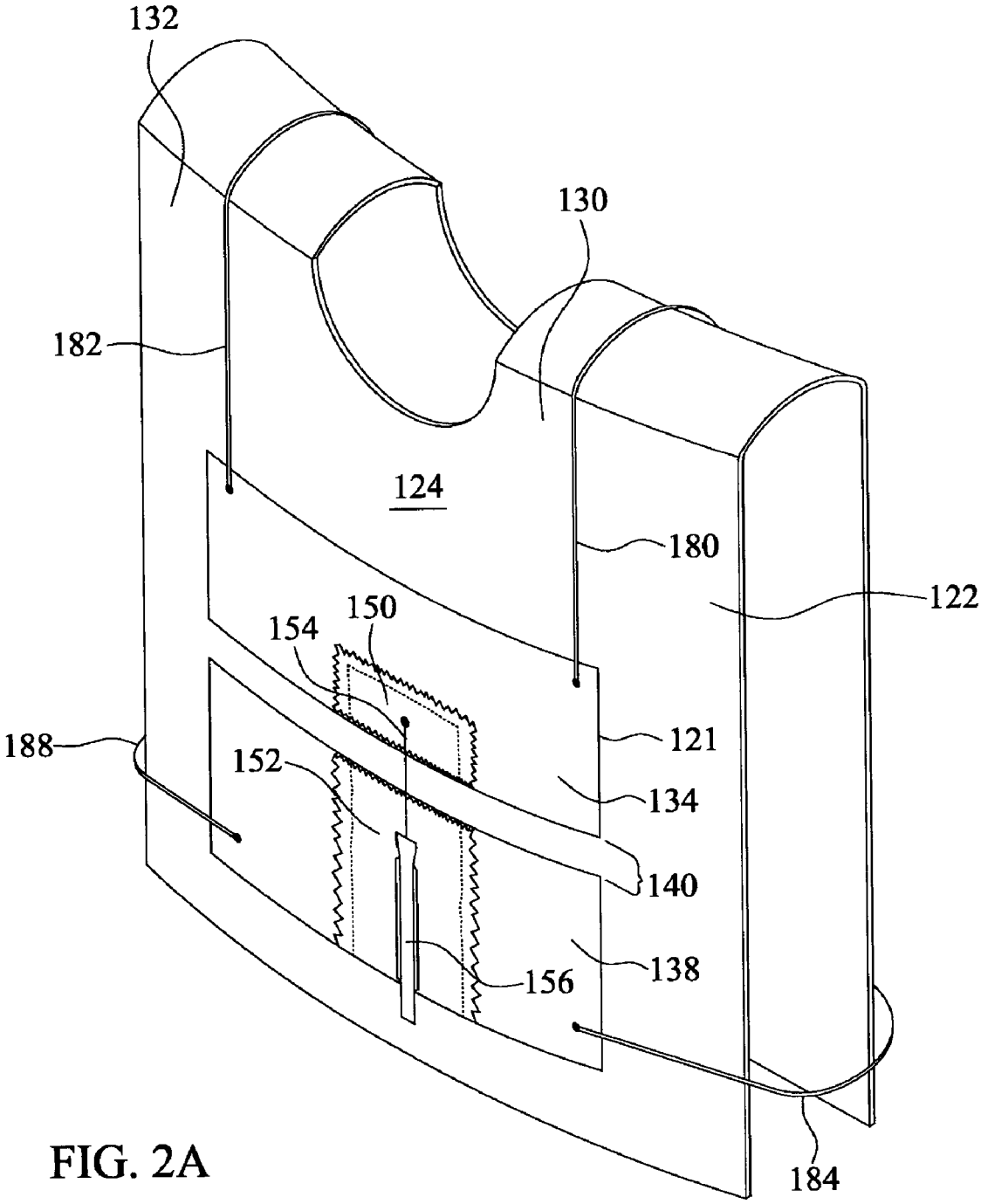
FIG. 2A illustrates an anterior view of a second antenna to be incorporated into a second garment.
Figure 2B:
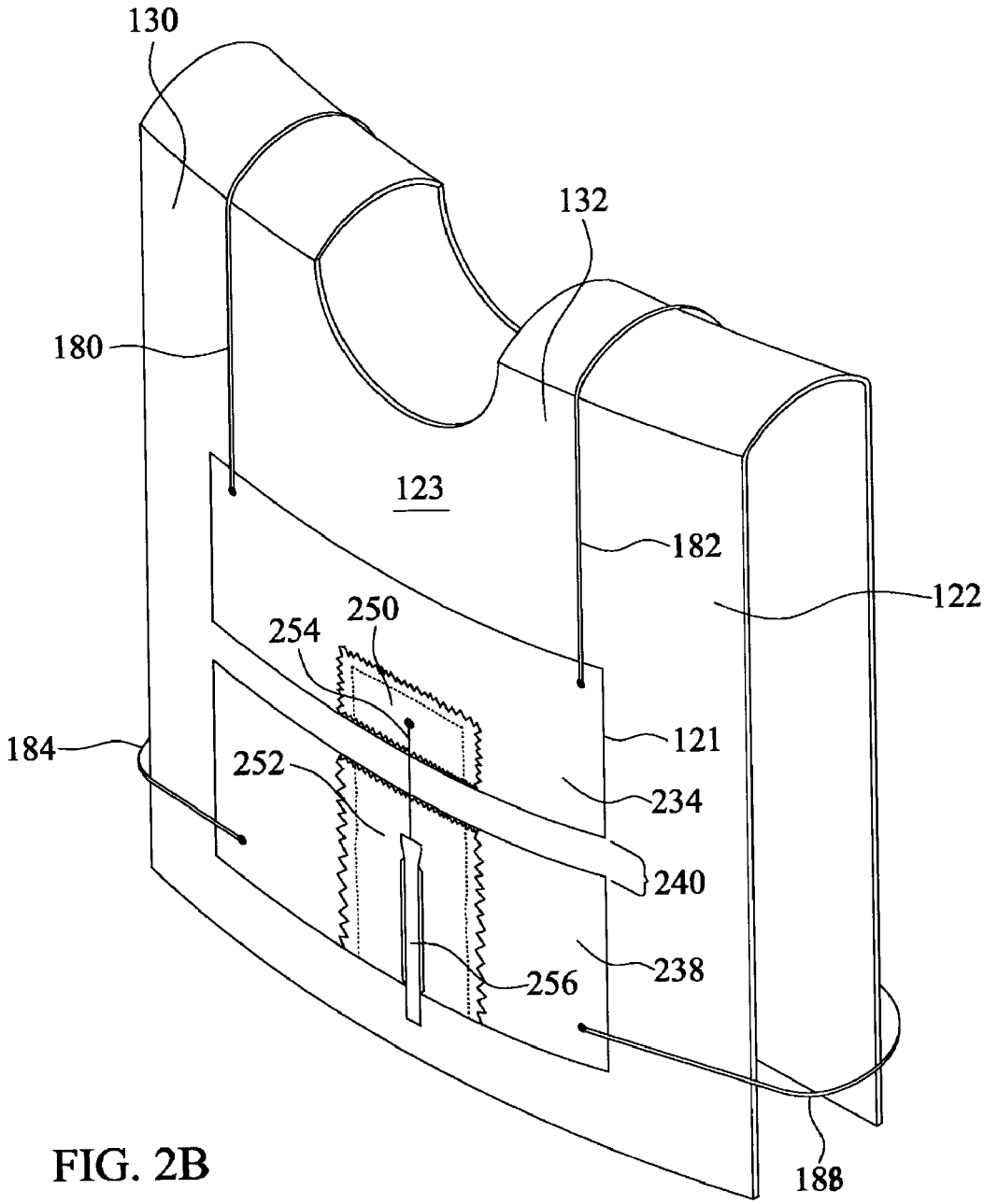
FIG. 2B shows a dorsal view of the second garment shown in FIG. 2A.

Referring now to FIGS. 2A and 2B, a second antenna 121 is integrated into second garment 122, which is made of an electrically nonconductive material such as a woven fabric selected from the group that includes cotton, wool, polyester, nylon, Kevlar, rayon, and the like. Second antenna 121 operates very efficiently over a frequency range of about 150 MHz to about 500 MHz. Second garment 122 has an outer layer with an anterior or front section 124 and a dorsal or back region 123. Second garment 122 also has a left shoulder section 130 and a right shoulder section 132.

As shown in FIGS. 2A and 2B, the anterior section 124 and dorsal region 123 of second garment 122 are mirror images of each other and include the same elements. Second antenna 121 includes a third RF element 134, a fourth RF element 138, second RF feed 154, second ground feed 156, all of which are attached to the front section 124 of second garment 122. Second antenna 121 also includes a fifth RF element 234, a sixth RF element 238, third RF feed 254, third ground feed 256, all of which are attached to the back region 123 of second garment 122. By way of example only, RF elements 134, 138, 234, and 238 are rectangular elements separated by a small gap. Other elements that may be used include a triangle (to form a bowtie antenna), a teardrop with a tapered feed, a "home plate," and others.

RF elements 134 and 138 are attached to second garment 122 so that the RF elements are separated by a gap 140, having a distance $D_2$. Similarly, RF elements 234 and 238 are attached to second garment 122 so that the RF elements are separated by a gap 240, having a distance $D_2$. Generally, $D_2 \leqq 0.7$ cm, although the scope of the invention includes the distance $D_2$ being greater than 0.7 cm as may be required to suit the requirements of a particular application. When RF energy is input, a voltage difference is generated across gaps 140 and 240.

Second antenna 121 also includes connecting wires 180, 182, 184, and 188, which improve the efficiency of second antenna 121. Connecting wires 180, 182, 184, and 188 electrically connect RF elements 134 and 138 on the front section 124 to RF elements 234 and 238 on the back region 123 of second garment 122. First and second connecting wires 180 and 182 electrically connect third RF element 134 to fifth RF element 234. First connecting wire 180 extends from the anterior region 124 to the dorsal region 123 of second garment 122 over left shoulder region 130. Second connecting wire 182 extends from the anterior region 124 to the dorsal region 123 of second garment 122 over right shoulder region 132. Third and fourth connecting wires 184 and 188 electrically connect fourth RF element 138 to sixth RF element 238. Third connecting wire 184 extends from the anterior region 124 to the dorsal region 123 of second garment 122 around the left side region of the wearer's torso. Fourth connecting wire 188 extends from the anterior region 124 to the dorsal region 123 of second garment 122 around the right side region of the wearer's torso.

Referring again to FIG. 2A, a flexible, electrically conductive patch 150 is sewn and/or bonded to the bottom center area portion of third RF element 134 on the anterior or front side 124 of second garment 122. Also a flexible, electrically conductive patch 152 is sewn and/or bonded to the center area of fourth RF element 138 on the anterior or front side 124 of second garment 122. The patches 150 and 152 are separated by gap 140, having a distance $D_2$. Second RF feed 154 is electrically connected to patch 150 by soldering or other conventionally known methods for electrically connecting a wire to another electrically conductive structure. A second ground feed 156 is electrically coupled to patch 152 by soldering or other means. Patches 150 and 152 provide a generally heat resistive buffer so that second ground feed 156 may be soldered to second antenna 121 without causing heat damage that would otherwise result if second RF feed 154 and second ground feed 156 were directly soldered to RF elements 134 and 138 in applications wherein the latter are made of Flectron®. It is to be understood that second RF feed 154 and second ground feed 156 are RF isolated from each other. By way of example, patches 150 and 152 may be made of electrically conductive copper foil tape such as 3M Scotch Tape, Model No. 1181.

Referring now to FIG. 2B, a flexible, electrically conductive patch 250 is sewn and/or bonded to the bottom center area portion of fifth RF element 234 on the dorsal or back region 123 of second garment 122. Also a flexible, electrically conductive patch 252 is sewn and/or bonded to the center area of sixth RF element 238 on the dorsal or back region 123 of second garment 122. The patches 250 and 252 are separated by gap 240, having a distance $D_2$. Third RF feed 254 is electrically connected to patch 250 by soldering or other conventionally known methods for electrically connecting a wire to another electrically conductive structure. A third ground feed 256 is electrically coupled to patch 252 by soldering or other means. Patches 250 and 252 provide a generally heat resistive buffer so that third ground feed 256 may be soldered to second antenna 121 without causing heat damage that would otherwise result if third RF feed 254 and third ground feed 256 were directly soldered to RF elements 234 and 238 in applications wherein the latter are made of Flectron®. It is to be understood that third RF feed 254 and third ground feed 256 are RF isolated from each other. By way of example, patches 250 and 252 may be made of electrically conductive copper foil tape such as 3M Scotch Tape, Model No. 1181.

Figure 3A:
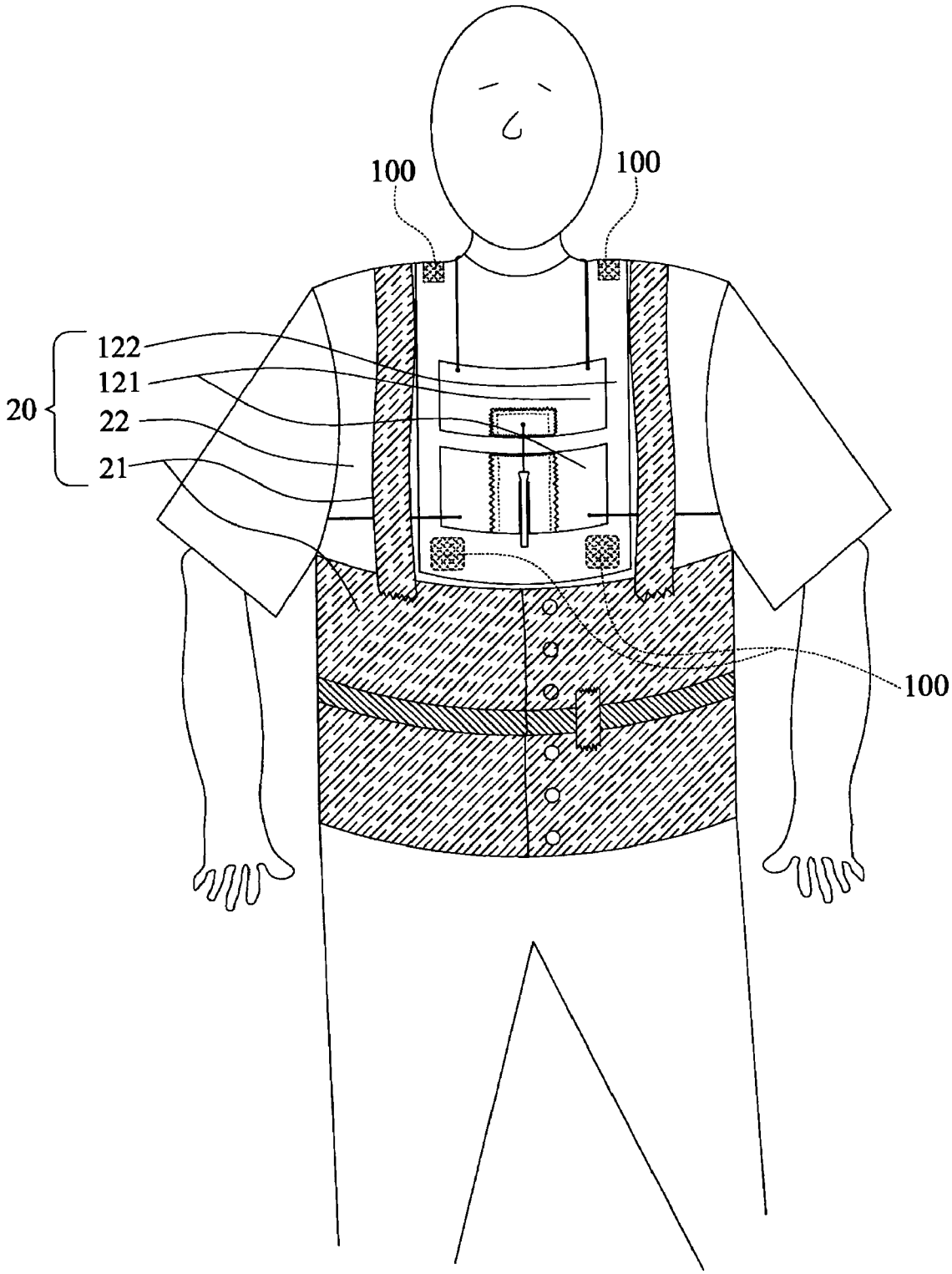
FIG. 3A illustrates an anterior view of first and second antennas incorporated into first and second garments as shown worn by a wearer.
Figure 3B:
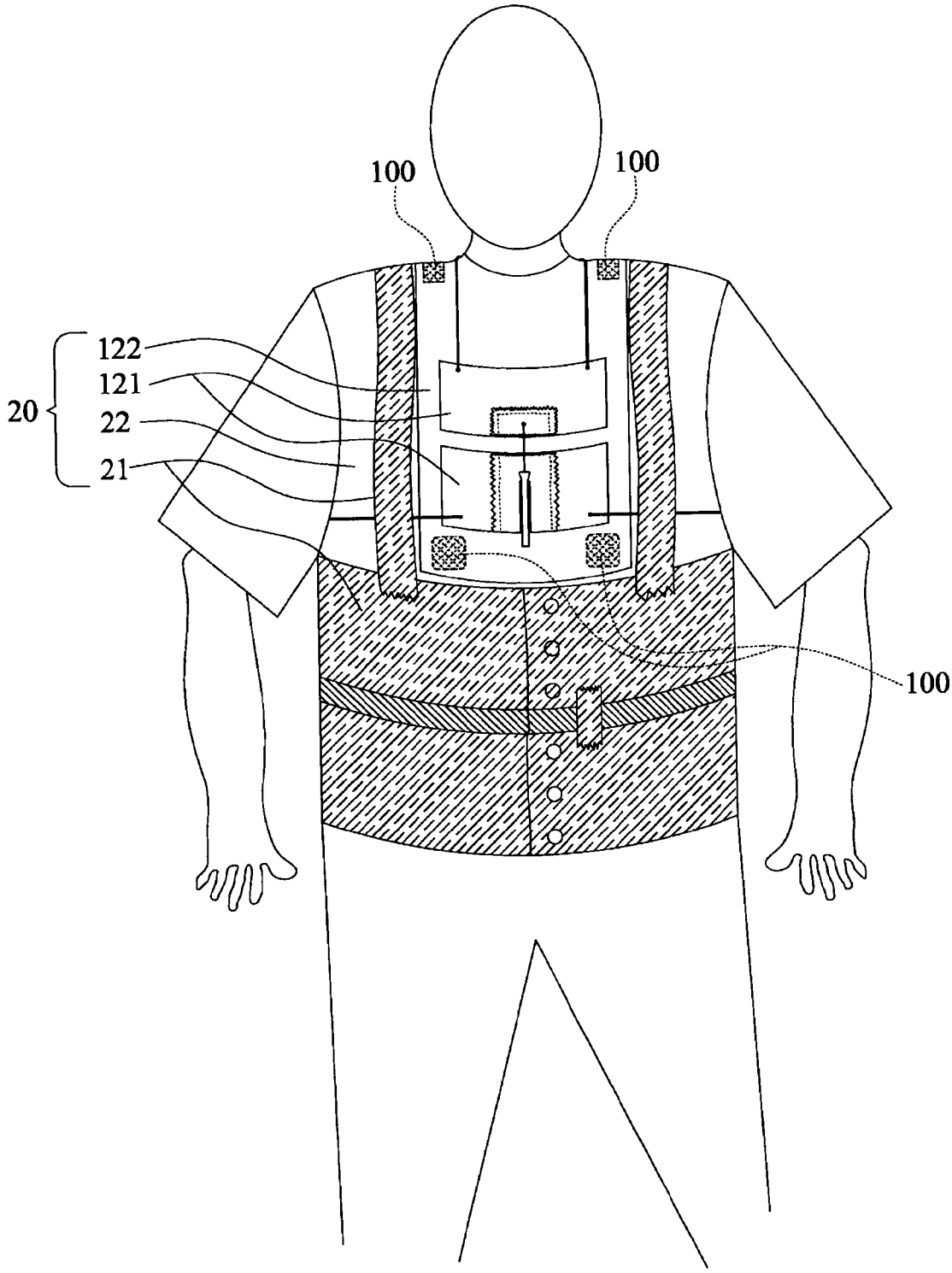
FIG. 3B shows a dorsal view of the antenna garments shown in FIG. 3A.

In FIGS. 3A and 3B, a human wearer 25 is shown wearing antenna garment 20 that includes first antenna 21 integrated into first garment 22 and second antenna 121 integrated into second garment 122. Second garment 122 is worn over first garment 22 and attached to first garment 22 by fasteners 100 (shown in FIGS. 1 and 2), such as Velcro® or snaps or may also be sewn. In another implementation of antenna garment 20, first antenna 21 and second antenna 121 may both be integrated into one garment, i.e., first garment 22.

Referring to FIGS. 1A, 1B, 2A, 2B, 3A, and 3B, collectively, RF elements 34, 38, 134, 138, 234, 238, shoulder straps 44 and 46, and shorting strap 42, are made of electrically conductive material such as metal selected from the group that includes copper, nickel, and aluminum. In the preferred embodiment, RF elements 34, 38, 134, 138, 234, 238, shoulder straps 44 and 46, and shorting strap 42, are made of an electrically conductive and very flexible mesh structure that includes woven copper or copper-coated fabric. If formed as a mesh, the mesh spacing should be less than about 0.1 $\lambda$, where $\lambda$ represents the shortest wavelength of the radio frequency signal that is to be detected or transmitted by first antenna 21 and second antenna 121. One type of suitable, electrically conductive mesh structure from which RF elements 34, 38, 134, 138, 234, 238, shoulder straps 44 and 46, and shorting strap 42 may be made is Flectron®, which is available from Applied Performance Materials, Inc. of St. Louis. The mesh size of Flectron® is much less than 0.1 for a frequency less than 500 MHz. A further characteristic of Flectron® is that it is breathable. Breathability is a very desirable characteristic for RF elements 34, 38, 134, 138, 234, 238, shoulder straps 44 and 46, and shorting strap 42 to facilitate dissipation of heat and moisture generated by wearer 25. However, the invention may be practiced wherein any or all of RF elements 34, 38, 134, 138, 234, 238, shoulder straps 44 and 46, and shorting strap 42 may be made with electrically conductive structures that are not breathable.

Figure 4A:
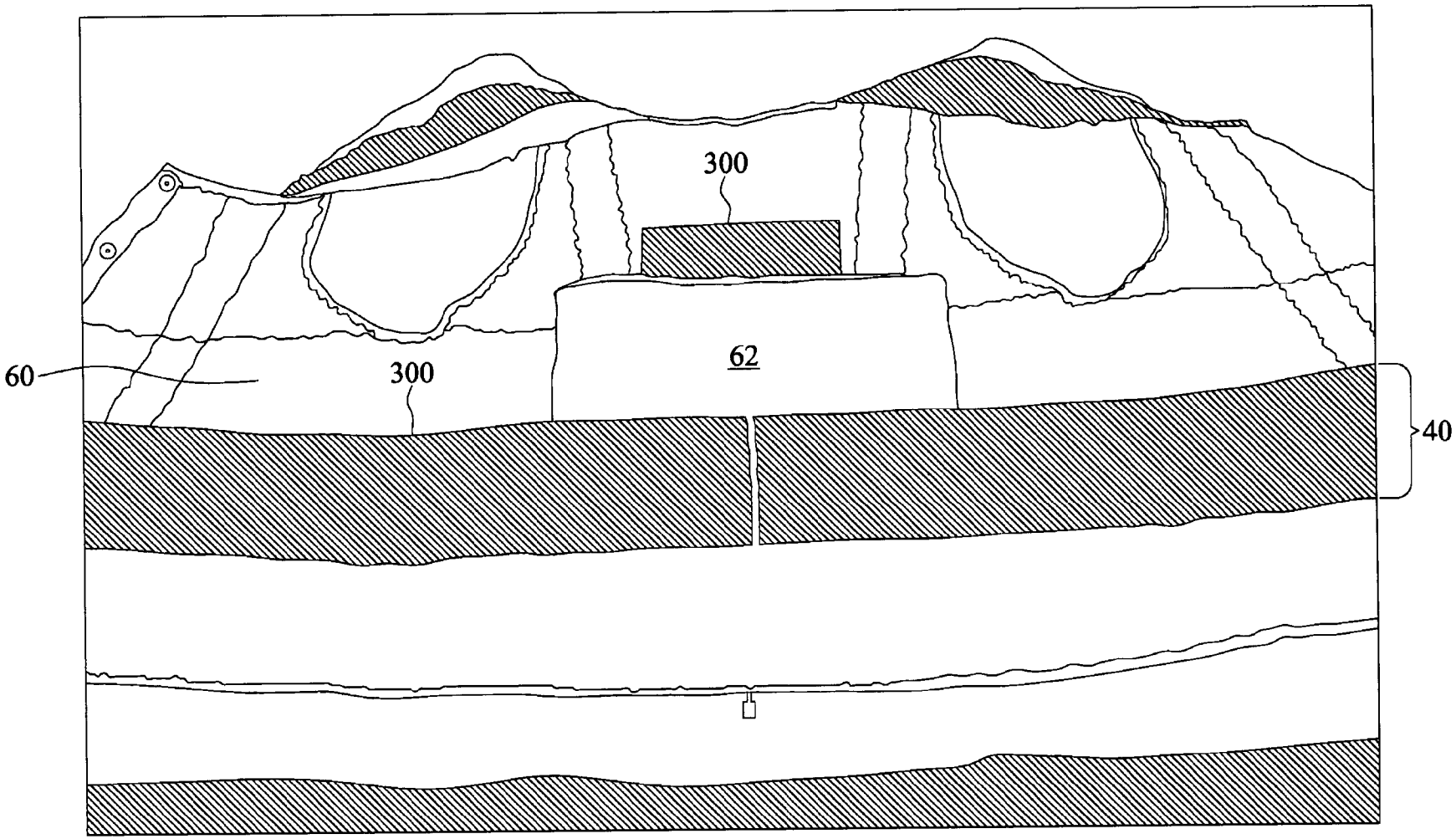
FIG. 4A shows an interior view of the first garment with tubular composites disposed within the inner layer of the garment.

FIG. 4A shows the inside layer 60 of antenna garment 20. In the preferred embodiment, a pocket 62 has been sewn on the inside layer of antenna garment 20 in the region of first RF feed 54. Insulating material 300 is disposed in pocket 62 and also disposed over the length and width of gap 40 that separates RF elements 34 and 38. Insulating material 300 decreases radiation hazard and increases gain.

Figure 4B:
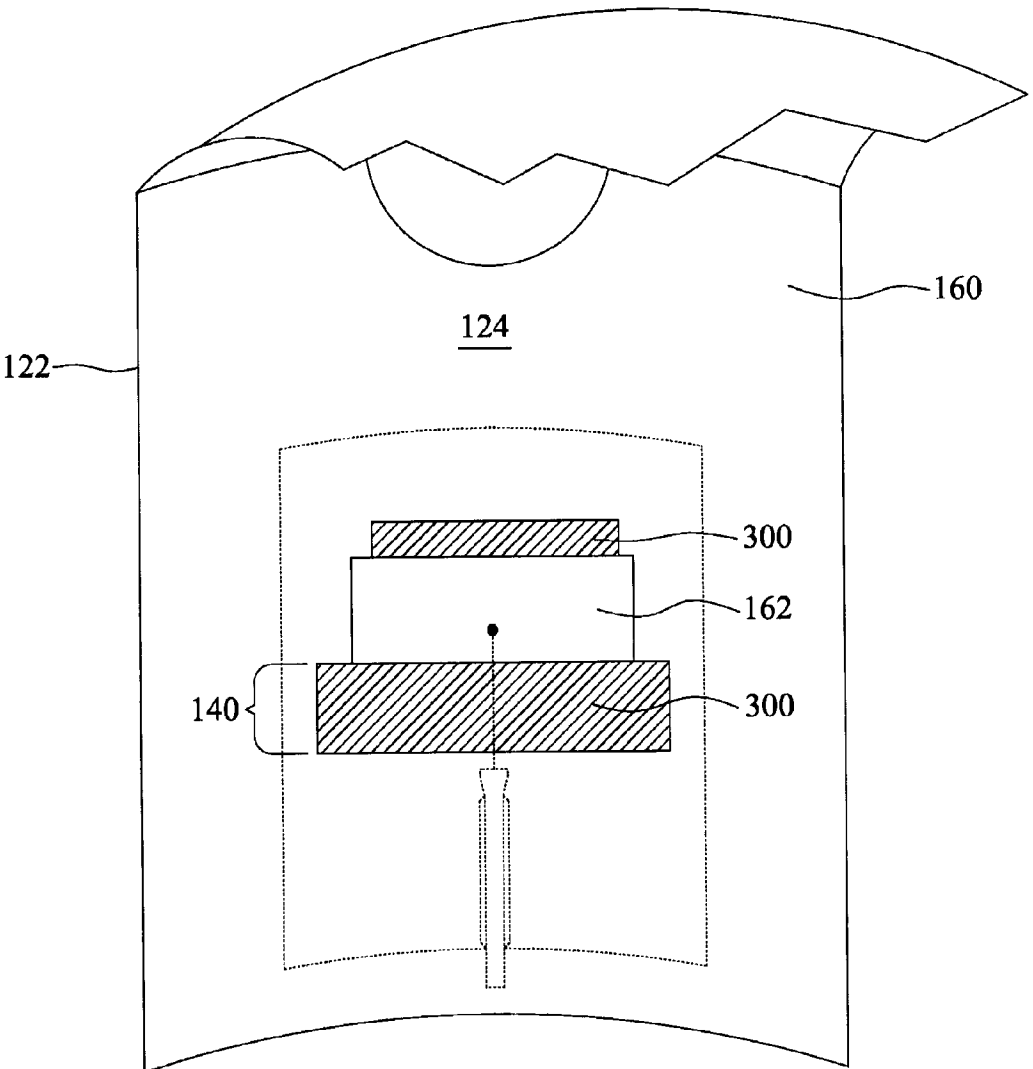
FIG. 4B shows an interior view of the front section of the second garment with tubular composites disposed within the inner layer of the garment.
Figure 4C:
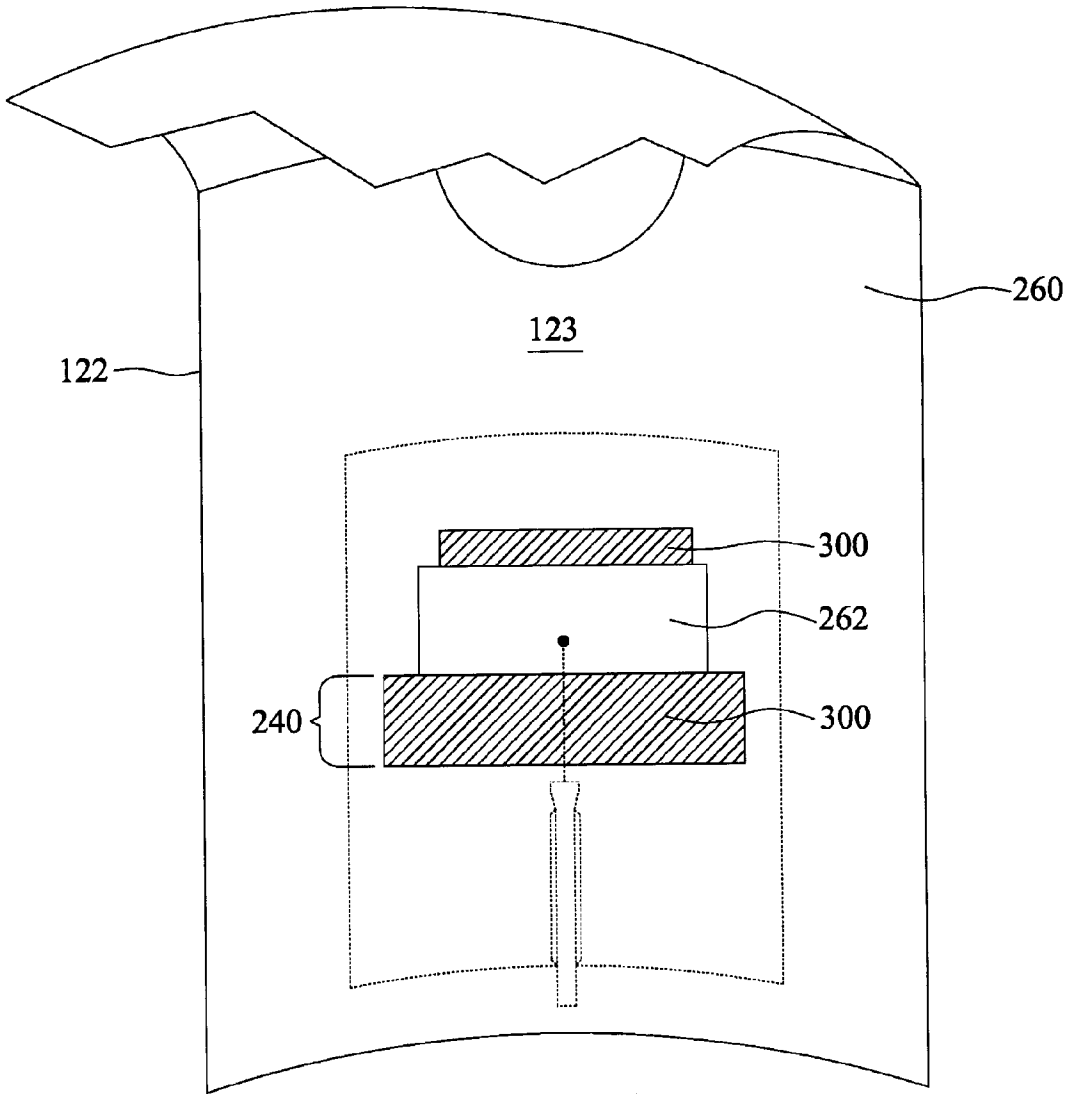
FIG. 4C shows an interior view of the back region of the second garment with tubular composites disposed within the inner layer of the garment.

FIG. 4B shows the inside layer 160 of the front section 124 of second garment 122. FIG. 4C shows the inside layer 260 of the back region 123 of second garment 122. Referring to FIGS. 4B and 4C, pockets 162 and 262 have been sewn on the inside layers 160 and 260 in the regions of second RF feed 154 and third RF feed 254, respectively. Insulating material 300 is disposed in pockets 162 and 262. Insulating material 300 is also disposed over the length and width of gap 140 that separates RF elements 134 and 138 and over the length and width of gap 240 that separates RF elements 234 and 238. By way of example, insulating material 300 may be made of material generally called tubular composites. To fabricate these tubular composites, cylinders of copper or ferrite tubules, 25 microns long and 1 micron in diameter, are mixed in controlled amounts with polyurethane or other polymers, which then solidify into a rubber-like sheet. Insulating material 300 reduces the energy that flows into the body and shields the wearer from electromagnetic radiation. Disposed over the length and width of gaps 40, 140, and 240 that separate the RF elements, insulating material 300 also reflects energy without shorting first antenna 21 and second antenna 121.

Figure 5:
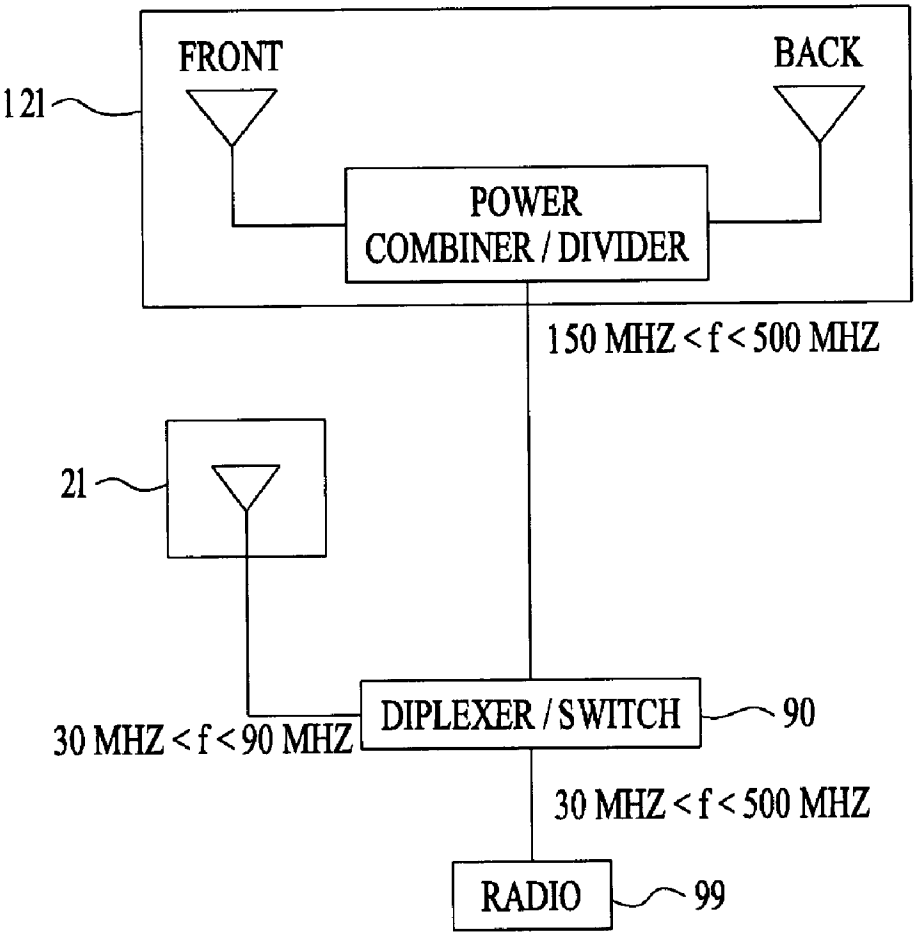
FIG. 5 is a block diagram of the circuit that combines a first antenna and a second antenna to form an improved ultra-broadband antenna.

FIG. 5 is a block diagram of the circuit that combines the first antenna 21, which is in the VHF band, and the second antenna 121, which is in the UHF band, to form an ultra-broadband antenna in the range of about 30 MHz to about 500 MHz. Use of multiple antennas, first antenna 21 and second antenna 121, with diplexer 90 allows optimization of each antenna within a narrower frequency range. The result is increased gain and reduced radiation hazard in a broad frequency range. Diplexer 90 creates a gap in coverage, e.g. 30 MHz–90 MHz, 150 MHz–500 MHz, but requires no operator intervention to route signals from radio 99 to the appropriate antenna for efficient operation. A switch, e.g., a single-pole, two-throw switch, does not have this "dead zone" but requires operator intervention to direct the signal to the appropriate antenna. A switch can also be operated by changing the waveform in radio 99.

Clearly, many modifications and variations of the improved ultra-broadband antenna incorporated into a garment are possible in light of the above teachings. It is therefore to be understood that within the scope of the appended claims, the invention may be practiced otherwise than as specifically described.

I claim:

1. An antenna garment to be worn by a wearer, comprising:

an electrically nonconductive garment having anterior and dorsal regions, and first and second shoulder regions;

an antenna that includes:

a first RF element attached to said garment;

a second RF element attached to said garment so that a gap exists between said first and second RF elements;

an RF feed electrically connected to said first RF element on said dorsal region of said garment for providing RF energy to said first RF element;

a ground feed electrically connected to said second RF element;

a first shorting strap that electrically connects said first and second RF elements on said anterior side of said garment;

a first strap electrically connected between said anterior and dorsal regions of said first RF element and which extends over a first shoulder region of said garment;

a second strap electrically connected between said anterior and dorsal regions of said first RF element and which extends over a second shoulder region of said garment;

a matching circuit electrically connected between said first RF element and said RF feed; and insulating material disposed within said antenna.

2. An antenna garment to be worn by a wearer, comprising:

an electrically nonconductive garment having anterior and second dorsal regions, first and second shoulder regions, and first and second side regions;

an antenna that includes:

a first RF element attached to said anterior region of said garment;

a second RF element attached to said anterior region of said garment so that a gap exists between said first and second RF elements;

a third RF element attached to said dorsal region of said garment;

a fourth RF element attached to said dorsal region of said garment so that a gap exists between said third and fourth RF elements;

a first RF feed electrically connected to said first RF element for providing RF energy to said first RF element;

a first ground feed electrically connected to said second RF element;

a second RF feed electrically connected to said third RF element for providing RF energy to said third RF element;

a second ground feed electrically connected to said fourth RF element;

a first connecting wire electrically connected between said first and third RF elements and which extends over a first shoulder region of said garment;

a second connecting wire electrically connected between said first and third RF elements and which extends over a second shoulder region of said garment;

a third connecting wire electrically connected between said second and fourth RF elements and which extends around a first side region of said garment; and a fourth connecting wire electrically connected between said second and fourth RF elements and which extends around a second side region of said garment; and insulating material disposed within said antenna.

3. Multi-antenna garments to be worn by a wearer, comprising:

a first electrically nonconductive garment having first outer and first inner layers, first anterior and first dorsal regions, and left and right shoulder regions;

a first antenna that includes:

a first RF element attached to said first garment;

a second RF element attached to said first garment so that a gap exists between said first and second RF elements;

a first RF feed electrically connected to said first RF element on said dorsal region of said first garment for providing RF energy to said first RF element;

a first ground feed electrically connected to said second RF element;

a first shorting strap that electrically connects said first and second RF elements on said first anterior side of said first garment;

a first strap electrically connected between said first anterior and first dorsal regions of said first RF element and which extends over a first shoulder region of said first garment;

a second strap electrically connected between said first anterior and first dorsal regions of said first RF element and which extends over a second shoulder region of said first garment; and a matching circuit electrically connected between said first RF element and said first RF feed;

a second electrically nonconductive garment attached to said first electrically nonconductive garment having second outer and second inner layers, second anterior and second dorsal regions, third and fourth shoulder regions, and first and second side regions;

a second antenna that includes:

a third RF element attached to said second anterior region of said second garment;

a fourth RF element attached to said second anterior region of said second garment so that a gap exists between said third and fourth RF elements;

a fifth RF element attached to said second dorsal region of said second garment;

a sixth RF element attached to said second dorsal region of said second garment so that a gap exists between said fifth and sixth RF elements;

a second RF feed electrically connected to said third RF element for providing RF energy to said third RF element;

a second ground feed electrically connected to said fourth RF element;

a third RF feed electrically connected to said fifth RF element for providing RF energy to said fifth RF element;

a third ground feed electrically connected to said sixth RF element;

a first connecting wire electrically connected between said third and fifth RF elements and which extends over a third shoulder region of said second garment;

a second connecting wire electrically connected between said third and fifth RF elements and which extends over a fourth shoulder region of said second garment;

a third connecting wire electrically connected between said fourth and sixth RF elements and which extends around a first side region of said second garment; and a fourth connecting wire electrically connected between said fourth and sixth RF elements and which extends around a second side region of said second garment; and insulating material disposed within said first and second antennas.

4. Multi-antenna garments of claim 3 wherein said first antenna operates with a voltage standing wave ration of less than 3:1 over a frequency range of 30 through 90 MHz.

5. Multi-antenna garments of claim 3 wherein said second antenna operates with a voltage standing wave ration of less than 3:1 over a frequency range of 150 through 500 MHz.

6. Multi-antenna garments of claim 3 wherein said insulating material is disposed over said gap between first and second RF elements of said first antenna.

7. Multi-antenna garments of claim 3 wherein said insulating material is disposed on the inside layer of said first electrically nonconductive garment opposed to region of said first RF feed of said first antenna.

8. Multi-antenna garments of claim 3 wherein said insulating material is disposed over said gap between third and fourth RF elements of said second antenna.

9. Multi-antenna garments of claim 3 wherein said insulating material is disposed over said gap between fifth and sixth RF elements of said second antenna.

10. Multi-antenna garments of claim 3 wherein said insulating material is disposed on the inside layer of said second electrically nonconductive garment opposed to region of said second RF feed of said second antenna.

11. Multi-antenna garments of claim 3 wherein said insulating material is disposed on the inside layer of said second electrically nonconductive garment opposed to region of said third RF feed of said second antenna.

12. Multi-antenna garments of claim 3 wherein said first, second, third, fourth, fifth and sixth RF elements are made of a flexible, electrically conductive material.

13. Multi-antenna garments of claim 12 wherein said flexible, electrically conductive material is a woven mesh structure.

14. A multi-antenna garment to be worn by a wearer, comprising:

an electrically nonconductive garment having outer and inner layers, anterior and dorsal regions, first and second shoulder regions, and first and second side regions;

a first antenna that includes:

a first RF element attached to said garment;

a second RF element attached to said garment so that a gap exists between said first and second RF elements;

a first RF feed electrically connected to said first RF element on said dorsal region of said garment for providing RF energy to said first RF element;

a first ground feed electrically connected to said second RF element;

a first shorting strap that electrically connects said first and second RF elements on said anterior side of said garment;

a first strap electrically connected between said anterior and dorsal regions of said first RF element and which extends over a first shoulder region of said garment;

a second strap electrically connected between said anterior and dorsal regions of said first RF element and which extends over a second shoulder region of said garment; and a matching circuit electrically connected between said first RF element and said RF feed;

a second antenna that includes:

a third RF element attached to said anterior region of said garment;

a fourth RF element attached to said anterior region of said garment so that a gap exists between said third and fourth RF elements;

a fifth RF element attached to said dorsal region of said garment;

a sixth RF element attached to said dorsal region of said garment so that a gap exists between said fifth and sixth RF elements;

a second RF feed electrically connected to said third RF element for providing RF energy to said third RF element;

a second ground feed electrically connected to said fourth RF element;

a first connecting wire electrically connected between said third and fifth RF elements and which extends over a first shoulder region of said garment;

a second connecting wire electrically connected between said third and fifth RF elements and which extends over a second shoulder region of said garment;

a third RF feed electrically connected to said fifth RF element for providing RF energy to said fifth RF element;

a third ground feed electrically connected to said sixth RF element;

a third connecting wire electrically connected between said fourth and sixth RF elements and which extends around a first side region of said garment; and a fourth connecting wire electrically connected between said fourth and sixth RF elements and which extends around a second side region of said garment; and insulating material disposed within said first and second antennas.

* * * * *